US010345760B2

(12) United States Patent
Kayano

(10) Patent No.: US 10,345,760 B2
(45) Date of Patent: Jul. 9, 2019

(54) DEVICE CASE AND TIMEPIECE

(71) Applicant: CASIO COMPUTER CO., LTD., Tokyo (JP)

(72) Inventor: Eri Kayano, Akiruno (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/791,776

(22) Filed: Oct. 24, 2017

(65) Prior Publication Data

US 2018/0173166 A1 Jun. 21, 2018

(30) Foreign Application Priority Data

Dec. 21, 2016 (JP) ..... 2016-247793

(51) Int. Cl.

| | |
|---|---|
| ***G04B 37/00*** | (2006.01) |
| ***G04B 37/08*** | (2006.01) |
| ***G04B 39/02*** | (2006.01) |
| ***G04B 43/00*** | (2006.01) |
| *G04G 99/00* | (2010.01) |

(52) U.S. Cl.

CPC ..... *G04B 39/02* (2013.01); *G04B 37/005* (2013.01); *G04B 37/088* (2013.01); *G04B 39/025* (2013.01); *G04B 43/002* (2013.01); *G04G 99/00* (2013.01)

(58) Field of Classification Search

CPC .... G04B 39/02; G04B 39/025; G04B 37/088; G04B 37/005

See application file for complete search history.

(56) References Cited

U.S. PATENT DOCUMENTS 3,858,388 A * 1/1975 Fujimori ..... G04B 39/02 368/291
4,136,515 A * 1/1979 Thompson ..... G04B 37/084 368/294

(Continued)

FOREIGN PATENT DOCUMENTS

CH 321187 A * 4/1957 ..... G04B 39/025
FR 1524811 A * 5/1968 ..... G04B 39/02

(Continued)

OTHER PUBLICATIONS

Koichiro, Matsushita, English Translation of JP2001021671, originally published Jan. 26, 2001, translation retrieved from Espacenet on Dec. 13, 2018, full document (Year: 2001).*

(Continued)

*Primary Examiner* — Daniel P Wicklund

(74) *Attorney, Agent, or Firm* — Scull, Scott, Murphy & Presser, P.C.

(57) ABSTRACT

A device case includes a resin case body having an opening which is disposed on a viewing face of the case body and a step which is disposed on an interior of the opening and protruding further to the interior than an inner face of the opening. The device case further includes a windproof member having an outer diameter smaller than an inner diameter of the opening of the case body and larger than an inner diameter of the step; and an adhesive section bonding and fixing the windproof member at a position to seal the opening of the case body. The adhesive section has higher flexibility than the case body.

6 Claims, 5 Drawing Sheets

(56) References Cited

U.S. PATENT DOCUMENTS

| | | | | | |
|---|---|---|---|---|---|
| 4,234,948 | A * | 11/1980 | Maekawa | G04B 37/084 | 368/291 |
| 4,474,482 | A * | 10/1984 | Gogniat | G04B 39/00 | 368/294 |
| 4,763,312 | A * | 8/1988 | Tokunaga | C08F 299/065 | 368/280 |
| 6,053,631 | A * | 4/2000 | Mock | G04B 19/14 | 368/281 |
| 6,213,635 | B1 * | 4/2001 | Savy | G04B 37/055 | 368/299 |
| 2005/0111307 | A1 * | 5/2005 | Saaski | G04B 19/28 | 368/314 |
| 2012/0118628 | A1 * | 5/2012 | Pakula | G06F 1/1626 | 174/520 |
| 2013/0329535 | A1 * | 12/2013 | Kaltenrieder | G04B 39/02 | 368/223 |
| 2017/0071064 | A1 * | 3/2017 | Hooton | G06F 1/1613 | |

FOREIGN PATENT DOCUMENTS

| | | | | |
|---|---|---|---|---|
| JP | S59-041779 | U1 | 3/1984 | |
| JP | 61294385 | A * | 12/1986 | G04B 39/025 |
| JP | S62-069187 | U1 | 4/1987 | |
| JP | H04-008991 | U1 | 1/1992 | |
| JP | H06-094848 | A | 4/1994 | |
| JP | 2001-021671 | A | 1/2001 | |
| JP | 2003-004869 | A | 1/2003 | |
| JP | 2006-105654 | A | 4/2006 | |

OTHER PUBLICATIONS

"Young Modulus for Rubber", Jan. 29, 2013, Chevalier Cleret, full document (Year: 2013).*

"Modulus of Elasticity, Young Modulus for Some Common Materials", Jun. 26, 2014, The Engineering Toolbox, full document (Year: 2014).*

"Acrylonitrile Butadiene Styrene (ABS) Typical Properties Generic ABS", Nov. 22, 2014, Prospector, full document (Year: 2014).*

Notification of Reasons for Refusal dated Jun. 5, 2018 received in Japanese Patent Application No. JP 2016-247793 together with an English language translation.

* cited by examiner

DEVICE CASE AND TIMEPIECE

CROSS REFERENCE TO RELATED APPLICATION

This application is based upon and claims the benefit of priority under 35 USC 119 of Japanese Patent Application No. 2016-247793 filed on Dec. 21, 2016, the entire disclosure of which, including the description, claims, drawings and abstract, is incorporated herein by reference in its entirety.

BACKGROUND OF THE INVENTION

1. Field of the Invention

The present invention relates to a device case and a timepiece.

2. Description of Related Art

Device cases of a timepiece and the like are conventionally provided with windproof members, such as transparent glass, on their viewing faces.

The device cases of a timepiece and the like, which accommodate precision electronic devices, should have high-pressure waterproofness and shock resistance.

A windproof member satisfying such requirements can be fixed to a device case through bonding of the windproof member to an opening in the device case or press-fitting of the windproof member into the opening of the device case with a packing disposed therebetween.

In the case where the device case is a resin device case composed of synthetic resin, such as a plastic (hereinafter, such a device case is also referred to as "resin case"), the resin case undergoes a higher level of expansion and contraction due to thermal expansion and deformation due to high pressure compared to metal cases.

Thus, the windproof member is usually press-fitted into the resin case with a packing disposed therebetween such that the windproof member can follow such expansion/contraction and deformation (for example, refer to Japanese Patent Application Laid-Open Publication No. 2003-4869).

Unfortunately, press-fitting of the windproof member applies a large force to the device case and thus may cause deformation of the device case.

Thus, the deformation of a device case should be prevented by further providing metal parts on the interior and/or exterior of the device case for correcting the shape of the device case, such as an interior cover inserted into the resin case or a bezel fitted to the exterior of the resin case, to reinforce the device case to prevent deformation.

Unfortunately, in such a structure for preventing deformation, the packing and the metal parts for reinforcement increases the outer diameter of the windproof member and the thickness of the resin of the device case, resulting in increased dimensions of the entire device case. The thickness of the resin of the device case should be increased to bear the force applied to the windproof member during press-fitting.

This increases the dimensions and weight of the device case, which offsets the advantage of a resin case of light weight and decreases design flexibility compared to those of a metal device case. This leads to an increase in restriction on the design.

SUMMARY OF THE INVENTION

An object of the present invention is to provide a small light device case composed of resin having high-pressure water-resistance and shock resistance, and a timepiece.

According to one aspect of the present invention, a device case includes: a resin case body having: an opening disposed on a viewing face of the case body; and a step disposed on an interior of the opening and protruding further to the interior than an inner face of the opening; a windproof member having an outer diameter smaller than an inner diameter of the opening of the case body and larger than an inner diameter of the step; and an adhesive section bonding and fixing the windproof member at a position to seal the opening of the case body, wherein the adhesive section has higher flexibility than the case body.

DESCRIPTION OF THE PREFERRED EMBODIMENT

With reference to FIGS. 1 to 4, a device case and a timepiece according to an embodiment of the present invention will now be described. The following embodiments involve various technically preferred limitations for accomplishing the present invention. The scope of the invention, however, should not be limited to the embodiments and drawings.

Figure 1:
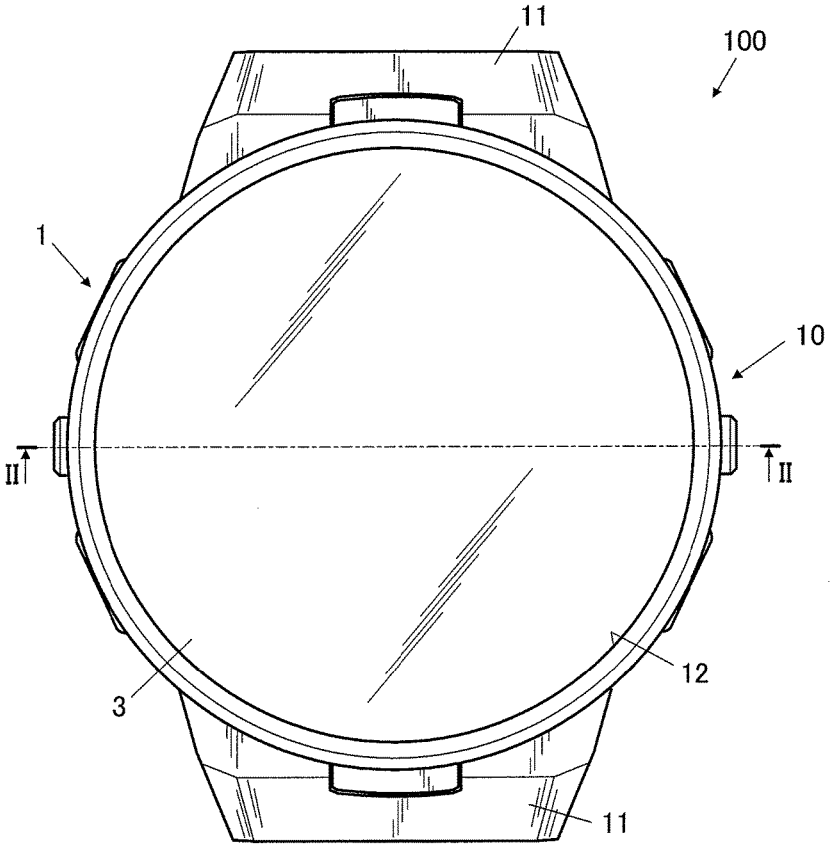
FIG. 1 is a front view of a timepiece according to an embodiment.
Figure 2:
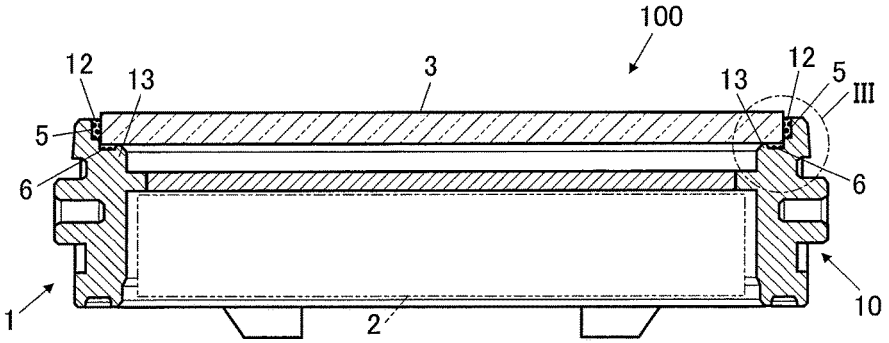
FIG. 2 is a schematic cross-sectional view of essential components taken along line II-II in FIG. 1.

FIG. 1 is a front view of a timepiece according to an embodiment. FIG. 2 is a schematic cross-sectional view of essential components taken along line II-II in FIG. 1.

With reference to FIGS. 1 and 2, a timepiece 100 according to this embodiment includes a device case 1 and a timepiece module 2 disposed inside the device case 1.

Although not illustrated in FIG. 1, a cover composed of soft resin, such as urethane, may be disposed on the exterior of the device case illustrated in FIG. 1. Such a cover absorbs shock applied from the outside and certainly prevents damage of the device case 1 and the timepiece module 2 inside the device case 1.

The device case 1 according to this embodiment includes a case body 10 having a shape of a short hollow column, a windproof member 3 fixed to the case body 10, and an adhesive section (adhesive subsections 5 and 6) that bond the windproof member 3 to the case body 10.

The case body 10 is composed of relatively hard synthetic resin, such as super-engineering plastics, i.e., ABS resin and polyarylate (PAR), and engineering plastics, i.e., polyacetal (POM) and polycarbonate (PC). Alternatively, the case body 10 may be composed of any other material.

The rear face (non-viewing face) of the timepiece 100 is sealed with a rear cover (not shown). The rear cover may be integrated with the case body 10.

Two band attachments 11 are disposed at opposite positions (opposite positions across the timepiece 100 in the vertical direction in FIG. 1) on the external face of the case body 10. The band attachments 11 are attached to bands (not shown).

Although not illustrated, the side face of the case body 10 (on the left and right sides of the timepiece 100 in FIG. 1) is provided with a button operated by a user to carry out various input operations.

The case body 10 accommodates the timepiece module 2.

The timepiece module 2 consists of a resin housing accommodating, for example, a circuit board provided with various electronic parts (not shown).

The timepiece module 2 is further provided with a battery (not shown) supplying electrical power to the components of the timepiece.

The case body 10 accommodates various functional units (not shown), such as a digital display including a liquid crystal display panel having a digital display function and/or an analog display including a timepiece face and hands, besides the timepiece module 2. The timepiece module 2 operates such functional units.

With reference to FIGS. 1 and 2, the case body 10 has an opening 12 in the timepiece 100 on the front face (the viewing face of the timepiece).

Figure 3:
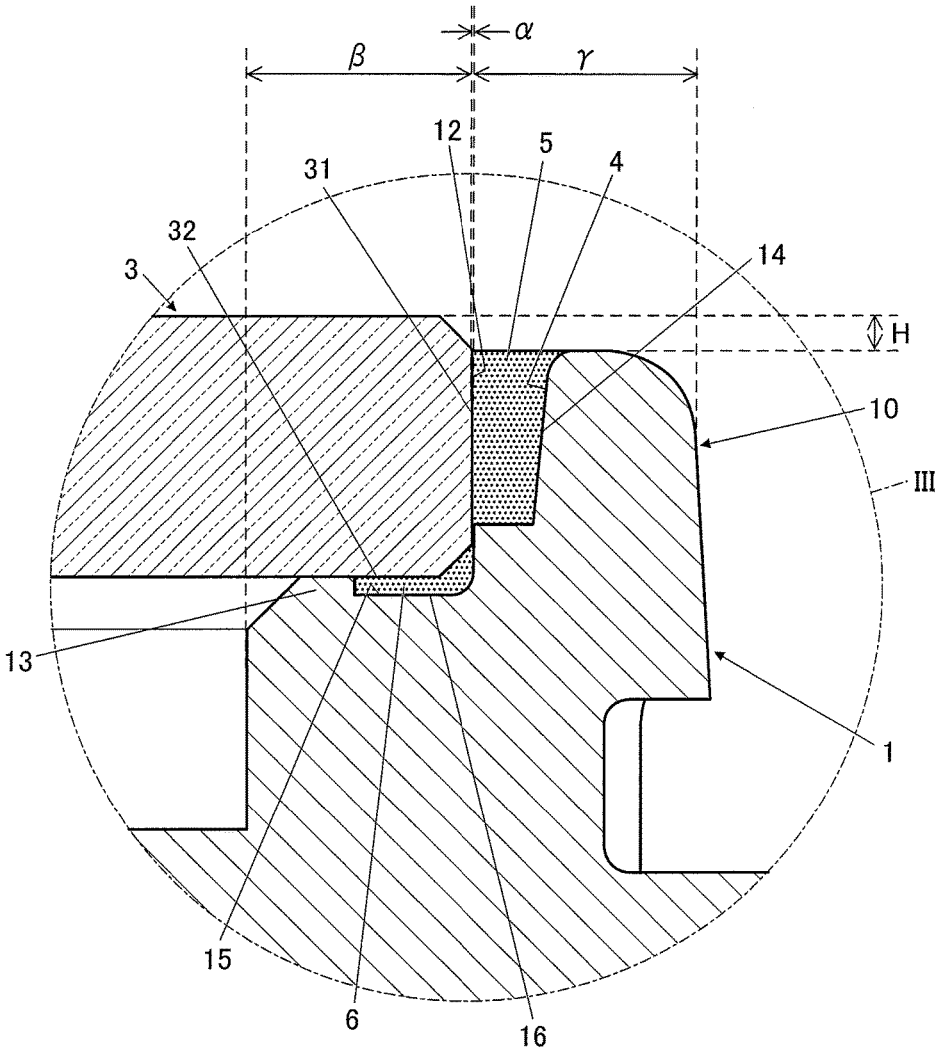
FIG. 3 is a cross-sectional view of essential components in the area III defined by a dash-dot line in FIG. 2.
Figure 4:
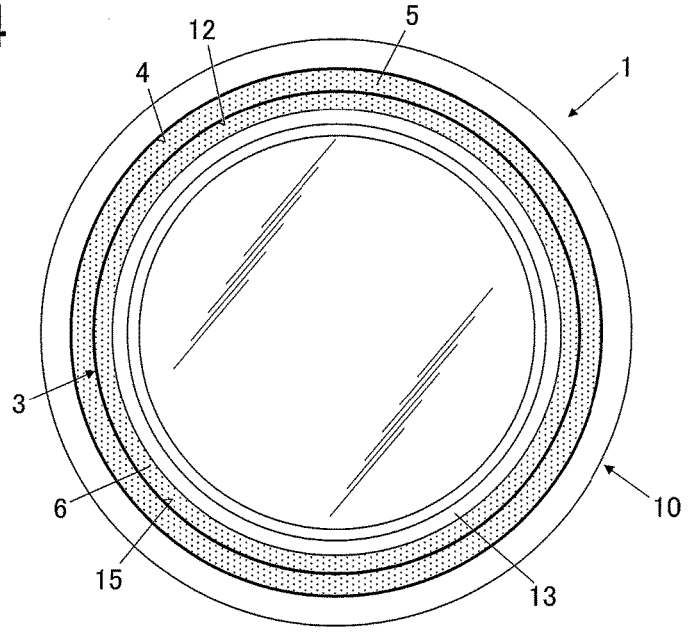
FIG. 4 is a schematic plan view of the viewing face of a device case of a timepiece.

FIG. 3 is a cross-sectional view of essential components of the opening 12 and the peripheral region in the area III defined by a dash-dot line in FIG. 2. FIG. 4 is a schematic plan view of the viewing face of the device case 1 of the timepiece 100.

The inner face of the opening edge of the opening 12 in the front face of the case body 10 has a groove 4 along the entire circumference of the opening 12. The groove 4 reduces the thickness of the case body 10 at the edge of the opening 12 to increase the diameter of the opening.

A step 13 protruding from the inner face of the opening 12 toward the interior of the case body 10 is disposed at a predetermined depth from the upper edge face of the case body 10.

With reference to FIG. 4, the step 13 according to this embodiment is disposed along the entire inner circumference of the opening 12.

The upper face of the step 13 according to this embodiment has a groove 15 along its entire circumference in a region connected to the inner face of the opening 12.

The windproof member 3 is a transparent member composed of, for example, inorganic glass, such as $SiO_2$ glass.

The windproof member 3 has an outer diameter smaller than the inner diameter of the opening 12 of the case body 10 and larger than the inner diameter of the step 13. The windproof member 3 is disposed so as to seal the opening 12.

The structure for fixing the windproof member 3 to the case body 10 will now be described in detail with reference to FIGS. 3 and 4.

With reference to FIG. 3, the gap a between the inner face of the opening 12 and the outer face of the windproof member 3 is significantly small. Thus, after the windproof member 3 is disposed in the opening 12, the position on the face of the windproof member 3 is substantially determined.

The peripheral edge of the lower face of the windproof member 3, which is disposed inside the opening 12, is disposed on the step 13.

The step 13 protrudes toward the interior of the device case 1 by a distance β from the outer face of the windproof member 3. Thus, the windproof member 3 disposed on the step 13 is supported by the step 13 from below. This determines the position of the windproof member 3 in the device case 1 in the thickness direction of the device case.

In this embodiment, an adhesive filling the groove 4 constitutes the lateral adhesive subsection 5 between the inner face 14 of the opening 12 and the outer face 31 of the windproof member 3, the lateral adhesive subsection 5 bonding the inner face 14 of the opening 12 and the outer face 31 of the windproof member 3.

The adhesive filling the groove 15 constitutes the lower adhesive subsection 6 between the upper face 16 of the step 13 (the groove 15 in the step 13) and the lower face 32 of the windproof member 3, the lower adhesive subsection 6 bonding the upper face 16 of the step 13 (the groove 15 in the step 13) and the lower face 32 of the windproof member 3.

In this embodiment, the lateral adhesive subsection 5 and the lower adhesive subsection 6 compose an adhesive section that bonds and fixes the windproof member 3 to a position that seals the opening 12 of the case body 10.

The adhesive section (the lateral adhesive subsection 5 and the lower adhesive subsection 6 in this embodiment) has flexibility in a cured state higher than that of the case body 10.

The term "high flexibility of the adhesive section" indicates that the cured adhesive of the adhesive section (the lateral adhesive subsection 5 and the lower adhesive subsection 6) has low hardness and high elasticity.

As described above, the case body 10 according to this embodiment is a resin case composed of synthetic resin, which is more prone to expansion and contraction due to thermal expansion and deformation due to high pressure compared to a metal case.

For example, the windproof member 3 composed of inorganic glass has a diameter of φ30.0, whereas the case body 10 of the resin case has a diameter of φ30.5. A variation in temperature within the range of −25° C. to 80° C. causes expansion/contraction of the diameter of the windproof member 3 within the range of approximately φ29.99 to φ30.02 and expansion/contraction of the diameter of the case body 10 within the range of approximately φ30.45 to φ30.64. Thus, the gap between the case body 10 and the windproof member 3 is within the range of 0.23 mm to 0.31 mm (a percentage of expansion/contraction within the range of 92% to 124%).

If the flexibility of the adhesive section (the lateral adhesive subsection 5 and the lower adhesive subsection 6) is lower than that of the case body 10, the adhesive section cannot follow the expansion/contraction of the case body 10. That is, if the case body 10 expands or contracts to a degree higher than that of the cured adhesive, the adhesive separates from the members bonded by the adhesive section (i.e., the case body 10 and the windproof member 3), impairing the air-tightness of the device case 1.

In particular, the lateral adhesive subsection 5 is readily affected by the expansion/contraction and deformation of the case body 10.

Thus, the adhesive section (the lateral adhesive subsection 5 in particular) has a thickness (i.e., a gap to be filled with an adhesive) sufficient for following the expansion/contraction of the case body 10. The hardness and an expansion/contraction rate after curing of the adhesive constituting the adhesive section are suitable for following the expansion/contraction rate of the case body 10.

Although any type of adhesive may be used, preferred examples include heat-curable adhesives and UV-curable adhesive. A variety of silicone, acrylic, and epoxy adhesives can be widely used that have low hardness (i.e., high softness) after curing, high elasticity, and high adhesiveness in bonding components composed of different materials, i.e., the resin case body 10 and the inorganic glass windproof member 3.

In the case where several adhesive subsections (the lateral adhesive subsection 5 and the lower adhesive subsection 6 in this embodiment) are provided, as in this embodiment, the adhesive subsections may be composed of the same adhesive or different materials.

For example, the adhesive of the lower adhesive subsection 6 has relatively high viscosity to prevent runoff from the groove 15 so that the windproof member 3 can be positioned after the groove 15 is filled with the adhesive, whereas the adhesive of the lateral adhesive subsection 5 has relatively low viscosity and rapidly spreads to fill the outer circumference of the windproof member 3 after the windproof member 3 is positioned. In this way, adhesives may be selected in accordance with the adhesive subsection.

In this embodiment, the groove 15 is disposed deeper in the opening 12 than the groove 4 (closer to the bottom of the device case 1 in the thickness direction).

Thus, even if the adhesive in the groove 4 runs off, the adhesive can be received by the groove 15 and prevented from flowing into the interior of the case body 10.

The windproof member 3, which is disposed in the opening 12 of the case body 10 and positioned on the step 13, is bonded such that the upper face of the windproof member 3 is disposed at a position higher than the upper edge of the opening 12 of the case body 10.

For example, as illustrated in FIG. 3, the upper face of the windproof member 3 is higher than the upper edge of the opening 12 of the case body 10 by a length H.

This can prevent the adhesive in the groove 4 from flowing over the windproof member 3.

The operation of the device case 1 and the timepiece 100 including the device case 1 according to this embodiment will now be described.

In this embodiment, the device case 1 is assembled by disposing the timepiece module 2 and the like inside the case body 10.

The groove 15 in the step 13 is filled with an adhesive. The adhesive filling the groove 15 preferably has relatively high viscosity to certainly position and bond the windproof member 3 and prevent runoff from the groove 15 into the case body 10.

After the groove 15 is filled with the adhesive, the windproof member 3 is disposed inside the opening 12 on the step 13. The windproof member 3 is disposed in tight contact with the adhesive inside the groove 15, and the adhesive is cured. That is, the adhesive is completely cured by heating if the adhesive is heat curable and by UV light irradiation if the adhesive is UV curable. The cured adhesive in the groove 15 constitutes the lower adhesive subsection 6 between the upper face 16 of the step 13 (the groove 15 in the step 13) and the lower face 32 of the windproof member 3. This determines the position of the windproof member 3.

The groove 4 in the opening 12 is filled with the adhesive. The adhesive filling the groove 4 preferably has relatively low viscosity so that the entire groove 4 can be filled as evenly as possible, to bond and fix the outer face of the windproof member 3 to the inner face of the opening 12. An adhesive having low viscosity may flow downward in the thickness direction of the case body 10. The groove 15 in the step 13 can prevent the adhesive from flowing into the case body 10. The upper face of the windproof member 3 disposed higher than the upper edge of the opening 12 of the case body 10 can prevent the adhesive from flowing on the upper face of the windproof member 3.

After the groove 4 is filled with the adhesive, the adhesive is cured. That is, the adhesive is completely cured by heat if the adhesive is heat curable and by UV light irradiation if the adhesive is UV curable. The cured adhesive in the groove 4 constitutes the lateral adhesive subsection 5 between the inner face 14 of the opening 12 and the outer face 31 of the windproof member 3, to fix the windproof member 3 to the opening 12 of the case body 10.

The lateral adhesive subsection 5 and the lower adhesive subsection 6 have flexibility after curing higher than that of the case body. Even if the case body 10 composed of resin expands or contracts due to heat or deforms due to external pressure, such as hydraulic pressure, the lateral adhesive subsection 5 and the lower adhesive subsection 6 can appropriately follow the expansion/contraction and deformation of the case body 10.

Thus, the adhesive between the case body 10 and the windproof member 3 does not readily separate and can maintain high air-tightness and waterproofness.

The flexibility of the lateral adhesive subsection 5 and the lower adhesive subsection 6 absorbs shock applied to the lateral adhesive subsection 5 and the lower adhesive subsection 6 from outside. This prevents damage to the device case 1 and damage to various components disposed inside the device case 1 without a separate shock absorber.

According to the embodiment described above, the flexibility of the cured adhesive section (the lateral adhesive subsection 5 and the lower adhesive subsection 6 in this embodiment) bonding and fixing the windproof member 3 at a position to seal the opening 12 of the case body 10 is higher than the flexibility of the case body 10.

In the case where the case body 10 of the device case 1 is composed of resin, the case body 10 is prone to expansion/contraction due to heat and deformation and distortion due to pressure, unlike a metal case. Thus, simply bonding and fixing the windproof member 3 to the case body 10 with an adhesive may cause separation and cracks in the adhesive, which may lead to impairment of air-tightness and shock resistance.

In the embodiment having the configuration described above, the adhesive section (the lateral adhesive subsection 5 and the lower adhesive subsection 6 in this embodiment) can flexibly follow the deformation of the case body 10 even under a severe environment that causes deformation of the resin case. This prevents separation and cracks in the adhesive, thereby maintaining the high air-tightness and shock resistance.

The flexibility of the adhesive section (the lateral adhesive subsection 5 and the lower adhesive subsection 6 in this embodiment) achieves a function of a shock absorber.

Thus, the device case 1 has excellent shock resistance.

In this embodiment, the adhesive section (the lateral adhesive subsection 5 and the lower adhesive subsection 6) can maintain high air-tightness, waterproofness, and shock resistance of the device case 1. Thus, separate reinforcements of the device case 1 are not required, such as a metal inner frame (such as an interior cover) and/or an external member (such as a bezel).

Thus, the diameter of the device case 1 is defined by the sum of the outer diameter of the windproof member 3 and the thickness y of the case body 10, as illustrated in FIG. 3. This is smaller than the diameter of the device case provided with a separate reinforcement. Unlike press-fitting a windproof member, the strength of the case body 10 at the opening 12 may be low and the thickness of the case body 10 at the opening 12 may be small. Thus, the device case 1 can have reduced dimensions and weight.

The adhesive section (the lateral adhesive subsection 5 and the lower adhesive subsection 6) also serves as a packing for maintaining air-tightness and a shock absorber. Thus, separate packing and shock absorber are not required. This decreases the number of components, which can achieve a simple configuration, a reduction in the number of assembly processing, and a small and light device case 1.

Since separate reinforcements of the device case 1, such as a metal inner frame and an external member, are not required, the timepiece 100 can have flexibility in design. Thus, the timepiece 100 can maintain high air-tightness and shock resistance while achieving an excellent design.

The adhesive section according to this embodiment includes the lateral adhesive subsection 5 bonding the inner face 14 of the opening 12 and the outer face 31 of the windproof member 3 to fix the windproof member 3 to the case body 10 and the lower adhesive subsection 6 bonding the upper face 16 of the step 13 and the lower face 32 of the windproof member 3.

The lower adhesive subsection 6 can certainly position and preliminarily fix the windproof member 3. The lateral adhesive subsection 5 and the lower adhesive subsection 6 can follow various deformations of the case body 10, such as expansion/contraction in the radial direction of the case body 10 and twisting and/or distortion of the case body 10.

In this embodiment, the groove 15 is disposed in the upper face of the step 13 in a region connected to the inner face of the opening 12. The lower adhesive subsection 6 is disposed in the groove 15.

Thus, the adhesive constituting the lower adhesive subsection 6 fills the groove 15 and does not readily flow over the groove 15 and spread onto the upper face of the step 13. This can prevent contamination of the interior of the case body 10 by the adhesive flowing into the case body 10.

In this embodiment, the upper face of the windproof member 3 is bonded and fixed to the case body 10 at a position higher than the upper edge of the opening 12 of the case body 10.

Thus, the adhesive can be prevented from attaching to the upper face of the windproof member 3 and contaminating the windproof member 3.

The above embodiments should not be construed to limit the present invention and may be appropriately modified within the gist of the present invention.

For example, in the embodiment described above, the groove 15 is disposed along the entire circumference of the case body 10 and the lower adhesive subsection 6 is disposed in the groove 15. Alternatively, the lower adhesive subsection may be disposed at any position and in any range.

Figure 5:
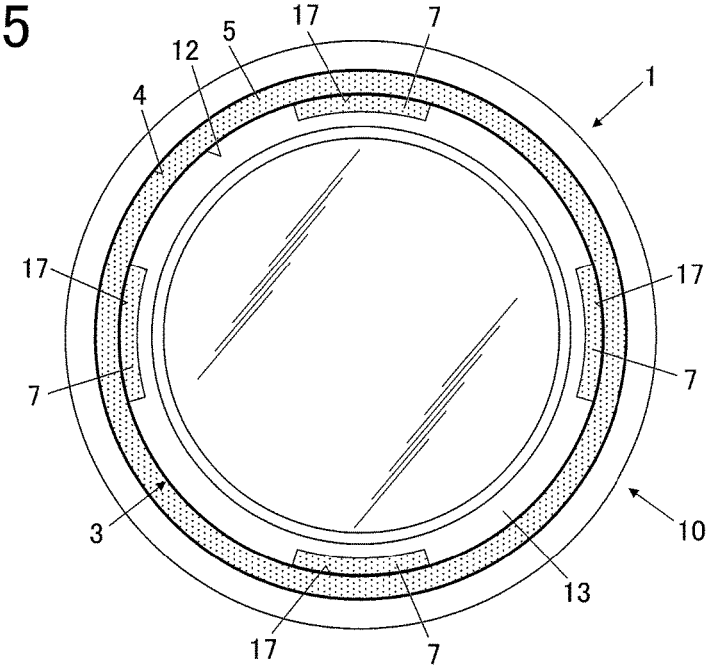
FIG. 5 is a schematic plan view of the viewing face of a timepiece according to a modification of an embodiment.

For example, as illustrated in FIG. 5, grooves 17 may be disposed at multiple positions on the step 13 (in four positions corresponding to 12, 3, 6, and 9 o'clock in an analog timepiece as in FIG. 5), and an adhesive filling the grooves 17 may constitute lower adhesive sections 7.

The lower adhesive sections should not be limited to be formed in grooves. Alternatively, a depression may be disposed in the step, be filled with an adhesive, and serve as a lower adhesive section.

An adhesive may be directly spread over the upper face of the step to serve as the lower adhesive section.

It is preferred that the lower adhesive section be disposed evenly on the step in view of the shock absorption of the lower adhesive section. It is preferred the lower adhesive section have a larger thickness achieved by filling the depression or groove with an adhesive because this can enhance shock absorption.

In this embodiment, the step 13 is disposed along the entire circumference of the case body 10. Alternatively, steps 13 may be disposed at several positions along the inner circumference of the case body 10.

In such a case, it is preferred that the steps 13 be disposed at substantially equal intervals along the inner circumference of the case body 10 (for example, four positions corresponding to 12, 3, 6, and 9 o'clock in an analog timepiece or three positions at substantially equal intervals), to stably position and dispose the windproof member 3.

Such intermittently disposed steps can even more reduce the weight of the device case In this embodiment, the adhesive section includes the lateral adhesive subsection 5 and the lower adhesive subsection 6. Alternatively, the adhesive section may include either the lateral adhesive subsection 5 or the lower adhesive subsection 6.

Figure 6:
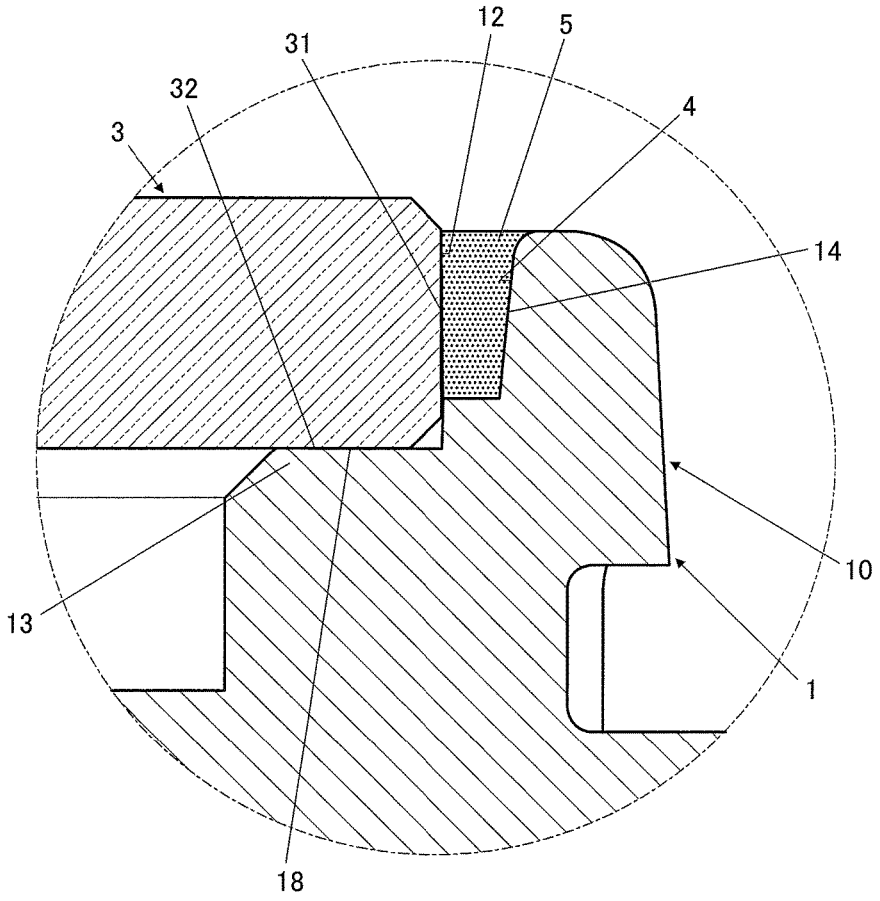
FIG. 6 is a cross-sectional view of essential components of an adhesive section bonding a device case and a windproof member according to a modification.

For example, the configuration in FIG. 6 includes only the lateral adhesive subsection 5.

Either one of the lateral adhesive subsection 5 and the lower adhesive subsection 6 maybe sufficient depending on the size of the device case and the required level of waterproofness and shock resistance.

Reducing the adhesive section leads to less number of assembly processing, thereby may achieve low costs.

Alternatively, at least one of the inner face 14 of the opening 12 and the outer face 31 of the windproof member 3 of the lateral adhesive subsection 5 may be an uneven face including at least one concave-convex portion.

Figure 7:
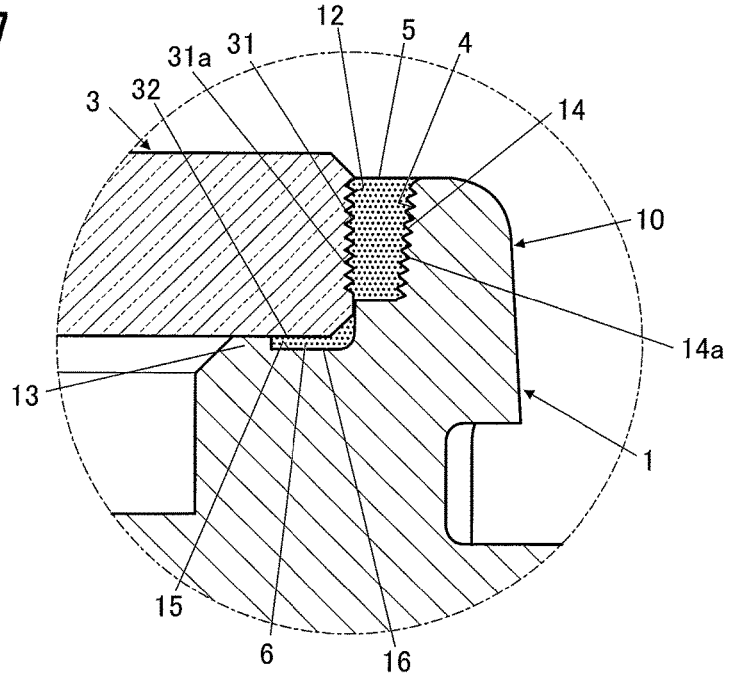
FIG. 7 is a cross-sectional view of essential components of an adhesive section bonding a device case and a windproof member according to a modification.

For example, in FIG. 7, multiple concave-convex portions 14*a* are disposed on the inner face 14 of the opening 12 so that the inner face 14 serves as an uneven face. Multiple concave-convex portions 31*a* are disposed on the outer face 31 of the windproof member 3 facing the inner face 14 so that the outer face 31 serves as an uneven face.

The uneven faces having the concave-convex portions 14*a* and 31*a* may be prepared through any means.

For example, the surface of the inner face 14 and the outer face 31 may be roughened through embossing, etching, or surface modification by flame treatment or discharge treatment, to prepare uneven faces having the concave-convex portions 14*a* and 31*a*. Alternatively, the uneven faces having the concave-convex portions 14*a* and 31*a* may be prepared through any other processing means.

The surface of the windproof member 3 may be provided with minute concave-convex portions by omitting polishing of the external face.

The face of the lateral adhesive subsection 5 may be an uneven face including concave-convex portions 14*a* and 31*a* to increase the surface area of the face of the lateral adhesive subsection 5, and thereby enhancing the bonding with the adhesive. The surface of the resin at the inner face 14 of the case body 10 may have enhanced wettability to increase the adhesiveness.

Figure 8:
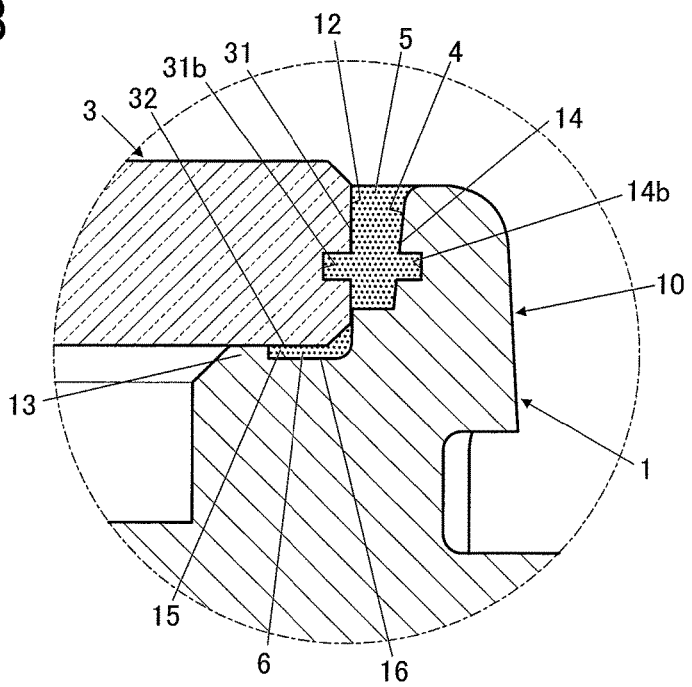
FIG. 8 is a cross-sectional view of essential components of an adhesive section bonding a device case and a windproof member according to a modification.

As in FIG. 8, a groove 14*b* may be disposed in the inner face 14 of the opening 12 and a groove 31*b* may be disposed in the outer face 31 of the windproof member 3.

In such a case, the adhesive fills the grooves 14*b* and 31*b* when the lateral adhesive subsection 5 is filled with the adhesive. Thus, the contact area can be increased between the surface of the lateral adhesive subsection 5 and the adhesive. Curing the adhesive in this state prevents the lateral adhesive subsection 5 from readily separating from the inner face 14 of the opening 12 and the outer face 31 of the windproof member 3.

The concave-convex portions 14*a* and 31*a* in FIG. 7 and the grooves 14*b* and 31*b* in FIG. 8 may be disposed on the entire circumferences of the inner face of the case body 10 and the outer face of the windproof member 3. Alternatively, they may be partially disposed in the inner face of the case body 10 and the outer face of the windproof member 3.

In this embodiment, the device case 1 has a circular shape in top view. The device case may have any other shape.

For example, the device case may have an elliptical or rectangular shape in top view.

In this embodiment, the device case 1 is included in the timepiece 100. Alternatively, the device case may be applied to any device besides a timepiece.

For example, the device case according to the present invention may be applied to a pedometer, a heart rate monitor, an altimeter, a barometer, or a terminal device such as a portable phone.

The embodiments described above should not be construed to limit the present invention, and the claims and other equivalents thereof are included in the scope of the invention.

What is claimed is:

1. A device case comprising:

a resin case body comprising:

an inner face defining an opening, the opening being disposed on a viewing face of the case body; and a step disposed on an interior of the opening, the step protruding from the inner face in a direction away from the inner face and further towards the interior of the opening;

a windproof member having an outer diameter smaller than an inner diameter of the opening of the case body and larger than an inner diameter of the step; and one or more adhesives for bonding and fixing the windproof member at a position to seal the opening of the case body, wherein a flexibility of the one or more adhesives is higher than a flexibility of the case body;

wherein the one or more adhesives comprises:

a lateral adhesive for bonding the inner face of the case body to an outer face of the windproof member to fix the windproof member to the case body; and a lower adhesive for bonding at least a portion of an upper face of the step to a corresponding portion of a lower face of the windproof member;

one of an upper face depression or an upper face groove is disposed on at least the portion of the upper face of the step, and the lower adhesive is disposed in the one of the upper face depression or the upper face groove.

2. The device case according to claim 1, wherein the windproof member is bonded and fixed to the case body such that an upper face of the windproof member is disposed at a position higher than an upper edge of the opening of the case body.

3. The device case according to claim 1, wherein at least one of the inner face of the case body and an outer face of the windproof member comprises an uneven surface comprising at least one concave-convex portion.

4. A timepiece comprising:

the device case according to claim 1; and a timepiece module disposed inside the device case.

5. The device case according to claim 1, further comprising one of an inner face depression or an inner face groove disposed on a portion of the inner face of the case body, wherein the lateral adhesive is disposed in the one of the inner face depression or the inner face groove.

6. The device case according to claim 5, wherein the one of the upper face depression or the upper face groove is in fluid communication with the one of the inner face depression or the inner face groove through a space formed by the inner face of the case body and the outer face of the windproof member.

* * * * *